United States Patent [19]

Resch

[11] Patent Number: 4,458,932

[45] Date of Patent: Jul. 10, 1984

[54] DISPOSABLE CONTAINER FOR ANIMAL WASTE

[76] Inventor: Jamie Resch, 4600 N. 72nd St., Milwaukee, Wis. 53218

[21] Appl. No.: 372,032

[22] Filed: Apr. 26, 1982

[51] Int. Cl.[3] ..... A01K 29/00

[52] U.S. Cl. ..... 294/1 B; 15/257.1; 294/55

[58] Field of Search ..... 294/1 R, 1 B, 1 BA, 294/1 BB, 55; 15/104.8, 257.1, 257.4, 257.6, 257.7, 257.9; 150/3-5, 49; 229/53, 55, 62; 248/95, 99, 101

[56] References Cited

U.S. PATENT DOCUMENTS

| | | | |
|---|---|---|---|
| 2,271,279 | 1/1942 | Thomas | 229/62 X |
| 2,483,169 | 9/1949 | Anderson | 229/62 |
| 3,426,958 | 2/1969 | Gore | 248/99 X |
| 3,767,247 | 10/1973 | Wetzler | 294/1 B |
| 3,806,984 | 4/1974 | Hilsabeck | 294/1 B |
| 3,830,423 | 8/1974 | Prescott | 294/1 B |
| 4,103,952 | 8/1978 | Thompson | 294/1 B |
| 4,138,153 | 2/1979 | Brown | 294/1 B X |
| 4,230,354 | 10/1980 | Claras | 294/1 B |

*Primary Examiner*—Johnny D. Cherry

*Attorney, Agent, or Firm*—Andrus, Sceales, Starke & Sawall

[57] ABSTRACT

A disposable container for picking up animal fecal waste includes a foldable frame constructed of a sheet of semi-rigid material and a plastic bag for holding the fecal waste. The sheet of material is slit, scored and perforated to define a scoop portion, a handle portion, and a removable shovel member. The handle portion is further slit and scored to define a gripping member and a pair of finger gripping tabs. The frame is initially in a flat, storage position and is foldable into an upright, operative position wherein the scoop and handle portions define a waste-receiving opening leading to the plastic bag. The bag is secured to the frame by means of a strip of adhesive on the scoop portion of the frame which attaches one portion of the bag, and an opening located adjacent the bag's mouth through which the finger gripping tabs project.

11 Claims, 5 Drawing Figures

DISPOSABLE CONTAINER FOR ANIMAL WASTE

BACKGROUND OF THE INVENTION

The present invention relates to containers for holding waste material, and more particularly to a disposable container for picking up animal fecal waste.

Pet animal excretia has become an increasing problem especially in major urban areas. Concern has developed from both an aesthetic point of view and because of the potential for the transmission of disease. In fact many municipalities and communities have enacted regulations which require pet owners to clean up all excrement after a dog has defecated. It is therefore desirable to provide a device which pet owners may utilize to pick up animal excretia.

Various pickup devices have been developed in the past which enable pet owners to clean up and properly dispose of their pet's excretia. U.S. Pat. Nos. 4,230,354, 4,138,153, and 4,103,953 show pickup devices having a plastic bag and a collapsible frame attached to the mouth of the bag, while U.S. Pat. No. 3,806,984 shows a rigid frame attached to the mouth of a collapsible plastic bag. In addition, U.S. Pat. Nos. 4,252,356 and 3,978,540 show pickup devices utilizing a bag together with a scooping tool, and U.S. Pat. Nos. 4,222,598, 4,155,581, 3,885,266, and 3,685,088 show pickup devices which are formed from a single blank of folded paperboard. Also, U.S. Pat. No. 4,017,015 shows a pickup device formed of two telescoping cartons which can be used to scoop up waste after which the two cartons are telescoped together for subsequent disposal.

SUMMARY OF THE INVENTION

A disposable container for picking up animal fecal waste. The container includes a foldable frame and receptacle means secured to the frame for holding the fecal waste. The frame is constructed of a sheet of semi-rigid material which is longitudinally slit and foldable along transverse lines to define a scoop portion and a handle portion. The frame is initially disposed in a flat, collapsed storage position, and is separable along the slit and foldable into an upright, operative position to define a waste-receiving opening leading to the receptacle means.

The receptacle means is constructed of a flexible impermeable material, such as polyethylene or polypropylene, and the frame is constructed of a single blank sheet of heavy paper or cardboard. As a result, the container may be inexpensively manufactured so as to permit disposal thereof after one use by a pet owner.

The scoop portion of the frame has a pair of spaced apart transversely extending score lines therein which define a scoop member. The scoop member is moved forward with a scooping action to engage and force the fecal waste through the waste-receiving opening into the receptacle means. The scoop portion of the frame also includes a shovel member removably joined to the scoop member along a perforated line. In addition, the handle portion of the frame is scored to define a pair of gripping walls, and is slit to define a pair of foldable finger gripping tabs.

Thus, when it is desired to utilize the frame, the shovel member is torn off from the blank sheet and the sheet is separated along the longitudinal slit. The frame is then folded into its upright, operative position such that the scoop member assumes a position which is spaced downwardly from the handle portion of the frame, and the gripping walls form a gripping member having a pair of finger gripping tabs extending upwardly therefrom.

The frame and bag may be assembled by inserting the finger gripping tabs through an opening formed in a portion of the bag which is adjacent its mouth, and by attaching another portion of the bag to an adhesive strip located on the underside of the scoop portion of the frame.

The present invention thus provides a disposable container for picking up animal fecal waste which is simple in design, inexpensive to manufacture, rugged in construction and easy to use.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
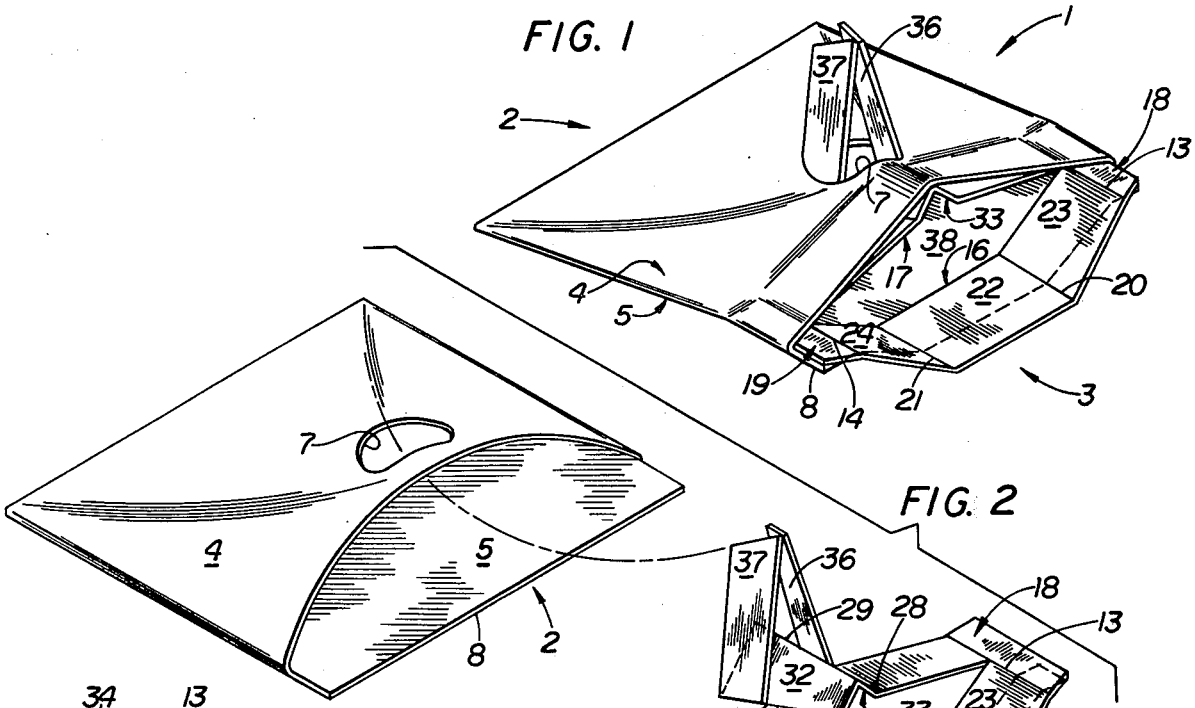
FIG. 1 is a view in perspective of a disposable container made in accordance with the present invention and assembled in its upright, operative position.

Referring now to the drawings, FIGS. 1–4 show a disposable container designated generally by the numeral 1 for picking up animal fecal waste. The container 1 includes a bag 2 for holding the animal waste, and a foldable frame 3. The bag 2 is constructed of an upper panel 4 and a lower panel 5 secured to one another along three sides of their periphery to form an opened mouthed receptacle means which provides an internal compartment 6 capable of holding animal fecal waste. The upper panel 4 includes an opening 7 formed therein adjacent the mouth of bag 2, and the lower panel 5 has a front edge margin 8 extending further forwardly than the free end of panel 4, as seen best in FIG. 2. The opening 7 is located centrally between the sides of bag 2, and the width of edge margin 8 is coincident with the width of bag 2. The function of opening 7 and edge margin 8 is to provide a means for securing the bag 2 to the frame 3, as will hereinafter be described.

The panels 4 and 5 of bag 2 are constructed of a thermoplastic material, such as high density polyethylene or polypropylene having a thickness of approximately one and one half mils. The panels 4 and 5 are preferably heat-sealed around their periphery, and are opaque so as to substantially conceal any waste material that may be contained in compartment 6.

Figure 5:
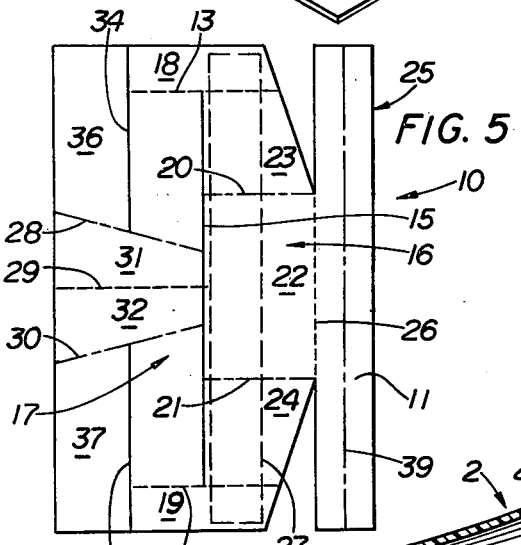
FIG. 5 is a plan view of a blank sheet used in constructing the frame of the container shown in FIG. 1.
Figure 3:
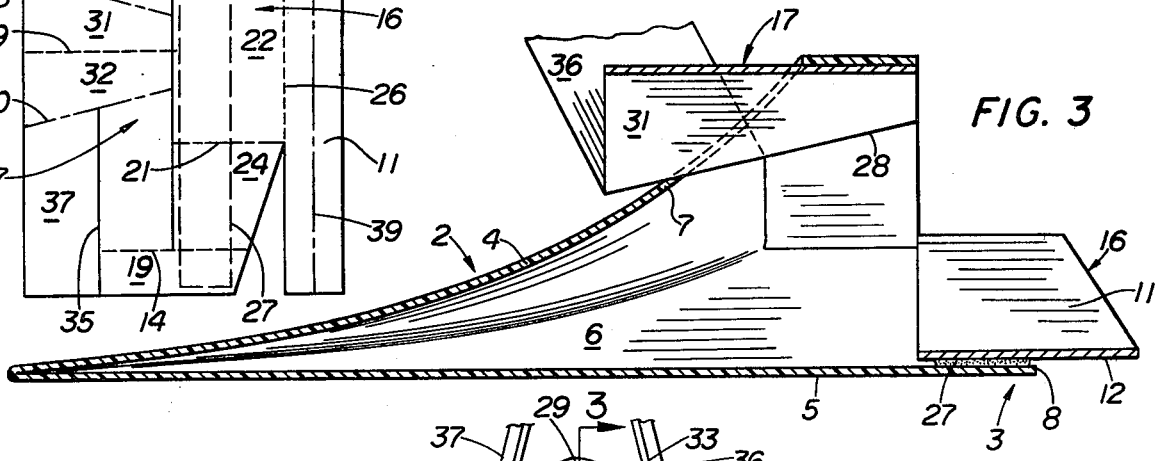
FIG. 3 is a cross-sectional view in elevation taken substantially along the plane of the line 3—3 in FIG. 4.

As shown in FIG. 5, frame 3 is constructed of a single blank sheet 10 of semi-rigid material, such as heavy paper or cardboard, or of a thermoplastic material which is thicker than the panels 4 and 5. For example, frame 3 may be constructed of ten or fourteen point paperboard, or of a high density polyethylene or polypropylene plastic material. These materials provide a rigid construction for frame 3 which still has some flexibility and has the capability to be scored and folded.

As seen best in FIG. 5, the sheet 10 of cardboard or like semi-rigid material has a length greater than its width, and defines an upper planar surface 11 and a lower planar surface 12. The sheet or blank 10 has a pair of spaced apart transversely extending perforated fold lines 13 and 14 formed therein, and a longitudinally extending slit or cut 15 formed therethrough extending between score lines 13 and 14. The score lines 13 and 14 are located adjacent opposite ends of sheet 10, and slit 15 is located at about the transverse center of sheet 10. The score lines 13 and 14 and slit 15 define a scoop portion 16, a handle portion 17 and a pair of end portions 18 and 19 which interconnect the scoop portion 16 and handle portion 17.

The scoop portion 16 has a pair of spaced apart transversely extending score lines 20 and 21 formed in its lower surface 12. The score lines 20 and 21 define a rectangular-shaped scoop member 22 and a pair of trapezoidal-shaped side walls 23 and 24 which interconnect the scoop member 22 with the end portions 18 and 19, respectively.

The scoop poriton 16 further includes a shovel member 25 removably attached or joined to the scoop member 22 along a perforated line 26. The line 26 is substantially parallel to slit 15 and permits member 25 to be easily torn off from member 22. Shovel member 25 has a longitudinally extending fold line 39 formed therein upon which the shovel 25 may be folded during the scooping operation. Scoop portion 16 also includes a strip of adhesive 27 covered and protected by a piece of tape which is removable when it is desired to assemble the bag 2 and frame 3. The strip 27 extends between opposite ends of portion 16 on lower surface 12 of sheet 10. The purpose of strip 27 is to secure the edge margin 8 of bag 2 to frame 3, as will hereinafter be described.

The handle portion 17 has three transversely extending lines 28–30 formed therein which define a pair of gripping walls 31 and 32. Perforated fold line 29 extends transversely in a direction substantially normal to slit 15 while score lines 28 and 30 extend at an angle with respect to line 29 and converge toward slit 15, as seen best in FIG. 5. Score lines 28 and 30 are formed in lower surface 12 which enable the gripping walls 31 and 32 to be foldable thereupon to form a V-shaped gripping member 33 projecting upwardly from handle portion 17, as seen best in FIGS. 2 and 4.

The sheet 10 further includes a second longitudinal slit or cut 34 formed therethrough extending from one end thereof to score line 28, and a third longitudinal slit 35 extending between the opposite end of sheet 10 and score line 30. The slits 34 and 35 are substantially parallel to slit 15 and form a pair of finger-gripping tabs 36 and 37 which are foldable along score lines 28 and 30, as seen best in FIG. 2.

Figure 2:
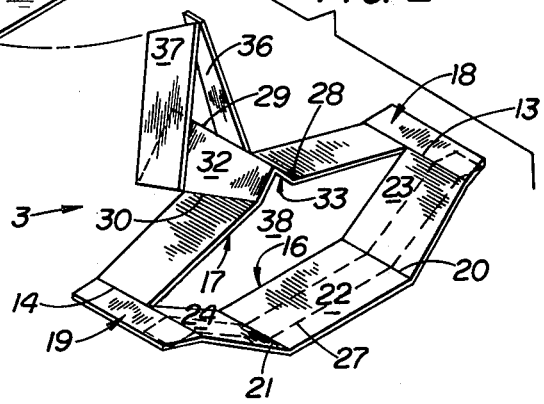
FIG. 2 is an exploded view in perspective showing the manner of assemblying the bag and frame constituting the container shown in FIG. 1.

The frame 3, scored and cut as described above, is initially disposed and packaged in a flat, collapsed, storage position, as shown in FIG. 5, wherein the scoop portion 16, handle portion 17 and end portions 18 and 19 are positioned in substantially the same plane. In order to extend the sheet 10 into its upright, operative position to form frame 3, the shovel member 25 is torn off of sheet 10 along line 26 and the scoop portion 16 and handle portion 17 are separated along slit 15 and folded as shown in FIG. 2 into their operative positions. In its operative position, the scoop portion 16 extends downwardly with respect to end portions 18 and 19 to define a waste-receiving opening 38. Thus, the scoop portion 16 is folded along lines 13, 14, 20 and 21 so that the linear scoop member 22 extends in a plane spaced below and parallel to the plane containing end portions 18 and 19, as seen best in FIG. 4. The handle portion 17 is then folded along lines 28–30 to form the upwardly projecting gripping member 33 and finger-gripping tabs 36 and 37. The shovel 25 is then folded along line 39 to form an angle member.

Figure 4:
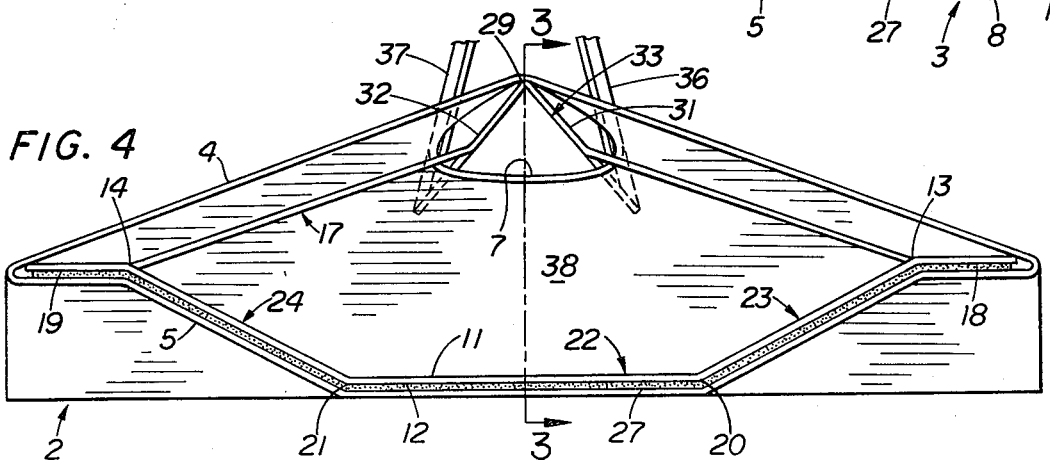
FIG. 4 is a front view in elevation partially in section of the container of FIG. 1.

Referring now to FIG. 2, frame 3 and bag 2 are assembled by inserting the finger-gripping tabs 36 and 37 through the opening 7 in the upper panel 4 of bag 2, and by removing the tape covering the adhesive strip 27 and pressing the edge margin 8 thereagainst, as shown best in FIG. 4. In order to use the container 1, the finger-gripping tabs 36 and 37 are gripped between the thumb and forefinger of one hand of the user and the frame 3 is moved forwardly with a scooping action so that the scoop member 22 engages the fecal matter. The shovel 25 is then held in the other hand of the user to force the waste material through the waste-receiving opening 38 of frame 3 into the internal compartment 6 of bag 2. Neither the user's hand nor fingers come into contact with the fecal matter since the fingers and hand are remote from the scooping area and are protected by the upper panel 4 of bag 2. The scooping operation may thus be cleanly and efficiently performed.

Various modes of carrying out the invention are contemplated as being within the scope of the following claims particularly pointing out and distinctly claiming the subject matter which is regarded as the invention.

I claim:

1. A disposable container for picking up animal fecal waste, comprising:

a frame constructed of a sheet of semi-rigid material having a predetermined length and width, said sheet having a pair of spaced apart transversely extending fold lines and a longitudinally extending slit formed therethrough extending between said pair of fold lines which define a scoop portion, a handle portion, and a pair of opposite end portions interconnecting said scoop and handle portions, said frame initially disposed in a flat collapsed storage position wherein said scoop, handle and end portions are postioned in substantially the same plane, and is foldable into an upright, operative position to define a waste-receiving opening; and receptacle means constructed of a flexible impermeable material secured to the frame about said waste-receiving opening to define a bag for holding animal fecal waste, said receptacle means includes a first portion secured to the scoop portion and a second portion secured to the handle portion of said frame, said handle portion includes a gripping member, and the second portion of said receptacle means has an opening formed therethrough for receiving said gripping member.

2. The container of claim 1, wherein the transversely extending fold lines in said sheet are located adjacent the ends of said sheet.

3. The container of claim 1, wherein said scoop portion includes a strip of adhesive for securing the first portion of said receptacle means thereto.

4. The container of claim 1, wherein said sheet further includes a shovel member removably attached to said sheet along a perforated line.

5. The container of claim 1, wherein said scoop portion has a pair of spaced apart transversely extending score lines therein defining a scoop member and a pair of opposite side walls interconnecting the scoop member with said end portions.

6. The container of claim 5, wherein said sheet defines a pair of oppositely disposed first and second surfaces, and the fold lines which define said end portions are perforated, and the score lines in said scoop portion are formed in one of said surfaces.

7. The container of claim 1, wherein said handle portion has a pair of spaced apart transversely extending score lines therein, and further includes a second longitudinally extending slit formed therethrough extending from one end of said sheet to one of said score lines, and a third longitudinally extending slit formed therethrough extending from the other end of said sheet to the other of said score lines, whereby said second and third slits define a pair of foldable finger gripping tabs.

8. The container of claim 7, wherein said handle portion has a transversely extending fold line therein located between said pair of score lines in said handle portion and spaced therefrom which defines a pair of gripping walls disposed medially the ends of said handle portion, said gripping walls are foldable upon the score lines and fold line in said handle portion to form the gripping member.

9. A disposable container for picking up animal fecal waste, comprising:

a frame constructed of a sheet of semi-rigid material having a predetermined length and width, said sheet having a pair of spaced apart transversely extending fold lines located adjacent the ends of said sheet and a longitudinally extending slit formed therethrough extending between said pair of fold lines which define a scoop portion, a handle portion, and a pair of opposite end portions interconnecting said scoop and handle portions, said scoop portion has a pair of spaced apart transversely extending fold lines therein defining a scoop member and a pair of opposite side walls interconnecting the scoop member with said end portions, said handle portion has a pair of spaced apart transversely extending fold lines therein, and further includes a second longitudinally extending slit formed therethrough extending from one end of said sheet to one of the fold lines in said handle portion, and a third longitudinally extending slit formed therethrough extending from the other end of said sheet to the other of the fold lines in said handle portion, whereby said second and third slits define a pair of foldable finger gripping tabs, said handle portion includes a third transversely extending fold line therein located between said pair of fold lines in said handle portion and spaced therefrom which defines a pair of gripping walls disposed medially the ends of said handle portion, said gripping walls are foldable upon the fold lines in said handle portion to form a gripping member, said frame initially disposed in a flat collapsed storage position wherein said scoop, handle and end portions are positioned in substantially the same plane, and is foldable into an upright, operative position to define a waste-receiving opening; and receptacle means constructed of a flexible impermeable material secured to the frame about said waste-receiving opening to define a bag for holding animal fecal waste, said receptacle means includes a first portion secured to the scoop portion and a second portion secured to the handle portion of said frame.

10. The container of claim 9, wherein said scoop portion includes a strip of adhesive for securing the first portion of said receptacle means thereto.

11. The container of claim 9, wherein said sheet further includes a shovel member removably attached to said sheet along a perforated line.

* * * * *